US006731264B2

(12) United States Patent
Koyama et al.

(10) Patent No.: US 6,731,264 B2
(45) **Date of Patent: *May 4, 2004**

(54) DRIVER CIRCUIT FOR DISPLAY DEVICE

(75) Inventors: Jun Koyama, Kanagawa (JP); Ritsuko Suzuki, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/037,336

(22) Filed: Nov. 9, 2001

(65) Prior Publication Data

US 2002/0057244 A1 May 16, 2002

Related U.S. Application Data

(63) Continuation of application No. 08/534,449, filed on Sep. 27, 1995, now Pat. No. 6,344,843.

(30) Foreign Application Priority Data

Sep. 30, 1994 (JP) ..... 6-261169

(51) Int. Cl.[7] ..... G09G 3/18
(52) U.S. Cl. ..... 345/100; 345/89; 345/204
(58) Field of Search ..... 345/87–104, 204, 345/208–210

(56) References Cited

U.S. PATENT DOCUMENTS

| | | | | |
|---|---|---|---|---|
| 4,802,106 A | | 1/1989 | Saito et al. | 345/440 |
| 5,038,139 A | * | 8/1991 | Fujisawa et al. | 340/784 |
| 5,051,739 A | * | 9/1991 | Hayashida et al. | 340/784 |
| 5,196,738 A | | 3/1993 | Takahara et al. | 307/296.1 |
| 5,218,352 A | | 6/1993 | Endoh et al. | 340/765 |
| 5,250,931 A | * | 10/1993 | Misawa | 345/206 |
| 5,264,839 A | | 11/1993 | Kanno et al. | 345/98 |
| 5,337,068 A | | 8/1994 | Stewart et al. | 345/88 |
| 5,353,041 A | | 10/1994 | Miyamoto et al. | 345/97 |
| 5,363,118 A | | 11/1994 | Okumura | 345/95 |
| 5,414,443 A | * | 5/1995 | Kanatani et al. | 345/95 |
| 5,457,661 A | | 10/1995 | Tomita et al. | 365/233.5 |
| 5,583,532 A | | 12/1996 | Watanabe | 345/89 |
| 5,583,535 A | * | 12/1996 | Takarada et al. | 345/99 |
| 5,592,190 A | * | 1/1997 | Okada et al. | 345/89 |
| 5,784,044 A | * | 7/1998 | Matsushiba | 345/113 |
| 6,177,920 B1 | * | 1/2001 | Koyama et al. | 345/100 |
| 6,344,843 B1 | * | 2/2002 | Koyama et al. | 345/100 |

FOREIGN PATENT DOCUMENTS

| | | |
|---|---|---|
| EP | 0 269 744 | 6/1988 |
| EP | 0 308 987 | 3/1989 |
| EP | 0 391 655 | 10/1990 |
| JP | 60-134292 | 7/1985 |
| JP | 62-265696 | 11/1987 |
| JP | 63-005390 | 1/1988 |
| JP | 63-262688 | 10/1988 |
| JP | 64-081995 | 3/1989 |
| JP | 02 264296 | 10/1990 |
| JP | 03 107994 | 5/1991 |
| JP | 3-119385 | 5/1991 |
| JP | 03 177890 | 8/1991 |
| JP | 04-060581 | 2/1992 |
| JP | 06 118904 | 4/1994 |
| JP | 06-266310 | 9/1994 |

* cited by examiner

*Primary Examiner*—Lun-Yi Lao
(74) *Attorney, Agent, or Firm*—Cook, Alex, McFarron, Manzo, Cummings & Mehler, Ltd.

(57) ABSTRACT

A driver circuit for use in an active matrix display having switching devices at pixels. The driver circuit uses no shift registers. Random access to signal lines or scanning lines can be obtained. The display quality is improved. The production yield is improved. Also, lower electric power consumption and higher-speed operation can be accomplished. Data about gray levels assumes the form of digital values and is supplied to the driver circuit. The signal lines or scanning lines are selected by an address decoder circuit.

24 Claims, 6 Drawing Sheets

DRIVER CIRCUIT FOR DISPLAY DEVICE

This application is a continuation of U.S. application Ser. No. 08/534,449, filed on Sep. 27, 1995, now U.S. Pat. No. 6,344,843.

BACKGROUND OF THE INVENTION

1. Field of the Invention

The present invention relates to a driver circuit for use in a display device and, more particularly, to a driver circuit adapted for use in an active matrix liquid crystal display.

2. Description of the Prior Art

Heretofore, a driver circuit for use in a display device such as an active matrix liquid crystal display has adopted line-sequential scanning making use of shift registers.

The whole prior art liquid crystal display is schematically shown in FIG. 1. A signal line driver circuit 101 and a scanning line driver circuit 102 are formed on the same glass substrate. Also, a liquid crystal pixel portion 103 is created in the center of the display device.

The driver circuits 101 and 102 are connected with the liquid crystal pixel portion 103 by signal lines X1, X2, . . . extending in the direction of columns and by signal lines Y1, Y2, . . . extending in the direction of rows. Thin-film transistors (TFTs) acting as switching devices are formed at the intersections of the signal lines and the scanning lines. That is, the TFTs are arranged in rows and columns.

The source electrodes of the TFTs are connected with the signal lines. The gate electrodes are connected with the scanning lines. The drain electrodes are connected with the pixel electrodes, which are located on the opposite side of a liquid crystal material from a counter electrode (not shown).

The signal lines are sequentially scanned by the signal line driver circuit 101. In synchronism with this scanning, signals are supplied to the liquid crystal pixel portion 103 via the scanning lines from the scanning line driver circuit 102. In this way, signals necessary to provide a display of images are applied to the liquid crystal pixel portion 103.

The line-sequential scanning is now described in detail. One input signal is transmitted with a delay. The signal lines in the scanning line driver circuit are sequentially scanned. Every transistor on one scanning line is once driven into conduction. Signals are supplied to signal storage capacitors via the signal lines from the signal line driver circuit. The supplied signals keep the liquid crystal material activated until scanning for the next frame is started.

At this time, if a constant voltage is kept applied to the liquid crystal material, then it will be deteriorated. In order to prevent this, the polarity of the display signal applied to the liquid crystal material is reversed every frame. In particular, the voltage applied to the source of each TFT forming a pixel is changed from a reference voltage of +10 V to +5 V and from the reference voltage to −5 V, and so on.

In the line-sequential scanning method described above, n stages of shift register circuits connected in series are employed to delay signals. The shift register circuits are made up of flip-flops. In the case of the signal line driver circuit, the number of stages n of the connected shift register circuits is the number of pixels in the horizontal direction. In the case of the scanning line driver circuit, the number of stages n is the number of pixels in the vertical direction.

The output signal from the shift register circuits connected in series is sent to the next stage of shift register circuit, delayed, and transmitted. Signal conversion circuits and amplification circuits such as analog memories and inverters are connected in series with the outputs of the shift register circuits.

FIG. 2 is a block diagram of an analog line-sequential driver circuit. This circuit includes a signal line driver circuit 200 and a scanning line driver circuit 201. The signal line driver circuit 200 consists of a shift register circuit composed of flip-flops connected in series. Power voltages Vdd (202) and Vss (203) are applied to the signal line driver circuit 200. Also, clock pulses CP (204) are applied to the signal line driver circuit 200. An applied start pulse SP (205) is passed through the flip-flops with delays in the direction of scanning (e.g., to the right), the flip-flops being connected in series inside the signal line driver circuit 200.

The shift registers deliver output signals Q0, Q1, . . . , Qn, respectively. Using these output signals as timing signals, a video signal 206 indicating data about gray levels is sampled by a sampling circuit using an analog switch 207.

The sampled data about the gray levels is once stored in an analog memory 208 before applied to the pixel portion. The stored data is scanned at the timing determined by latch pulses 209 supplied from the outside. The signal is subjected to an impedance transformation in an analog buffer 210. Then, the signal is sent to a pixel TFT 212 through a signal line 211. In each stage of the signal line driver circuit 200, such a signal path is followed. As a result, an image is scanned along the successive lines sequentially.

In recent years, digital memories using latches have been increasingly employed instead of analog memories. That is, data signal is not stored in analog memories but applied to latches, where the image data is retained as a binary-coded digital signal.

By digitizing signals in this way, decreases of the life of gray-level display data as encountered in the analog configuration are avoided. Hence, stable gray-level signals can be obtained.

Furthermore, lower voltage and lower electric power consumption can be accomplished by utilizing the digital scheme. This, in turn, leads to lower costs. In addition, the operation speed can be made higher.

With the prior art display device driver circuit using shift register circuits, if any one of the shift register circuits connected in series is defective, then no signal is transmitted to the following stages of shift register circuits. This causes a decrease in the production yield of the whole display device.

Every signal necessary to provide a display is carried by one video signal and so a high voltage is necessitated. As a result, the electric power consumed is increased.

The video signal is passed via the sampling circuit to the analog memory (capacitor) and once stored there. Electric charge leaks from this analog memory. Therefore, it may not be possible to store a required amount of electric charge. This shortens the life of the display data signal. In consequence, the image quality is deteriorated.

Especially, where the driver circuits are made up of TFTs formed on a glass substrate or the like, the driver circuits occupy a broader area than driver circuits formed on a single-crystal substrate. Therefore, faults are more likely to occur. For this reason, a driver circuit and a liquid crystal display portion are integrally formed on a glass substrate.

In the case of an active matrix liquid crystal display incorporating a peripheral circuit, faults tend to occur with the TFTs forming shift registers, thus deteriorating the production yield of the finished display device. As a result, the cost is increased.

In a line-sequential analog driver circuit, every necessary gray-level data is carried by only one video signal. Therefore, a high voltage is needed. This shortens the lifetime of the circuit made up of TFTs. The electric power consumed is inevitably increased.

Where an analog memory is used, there is the possibility that the life of the gray-level display data is shortened due to leakage of electric charge from capacitors. Therefore, it is difficult to accomplish high image quality.

SUMMARY OF THE INVENTION

It is an object of the present invention to provide a display device driver circuit which is free of the foregoing problems, can have a shortened scanning time, and enables high-speed operation and lower electric power consumption.

It is another object of the invention to provide a driver circuit which is for use in a display device and which permits the display device to be manufactured with higher yield.

One embodiment of the present invention resides in a driver circuit for use with an active matrix liquid crystal display having switching devices at pixels, said active matrix liquid crystal display having signal lines and scanning lines, said driver circuit receiving data about gray levels, said data being represented in terms of digital values. This driver circuit is characterized in that it has an address decoder circuit for selecting desired ones from said signal lines and scanning lines.

Another embodiment of the invention resides in a driver circuit for use with an active matrix liquid crystal display, said active matrix liquid crystal display having signal lines and scanning lines, said driver circuit receiving data about gray levels, said data being represented in terms of digital values. This driver circuit comprises: an address decoder circuit for selecting signal lines to which said data about gray levels is sent; a gray level-holding circuit for holding said data about gray levels; a gray level-synchronizing circuit for synchronizing timing at which said held data is sent with timing of scanning of said liquid crystal display; and a decoder circuit for selecting gray level potentials to be sent to said signal lines according to said gray level data synchronized by said gray level-synchronizing circuit.

A further embodiment of the invention resides in a driver circuit for use with an active matrix liquid crystal display, said active matrix liquid crystal display having signal lines and scanning lines, said driver circuit receiving data about gray levels, said data being represented in terms of digital values. This driver circuit comprises: an address decoder circuit for selecting signal lines to which said data is sent; a gray level-holding circuit for holding said data about gray levels in synchronism with an output signal from said address decoder circuit; a gray level-synchronizing circuit for synchronizing timing at which said held data is sent with timing of scanning of said liquid crystal display; and a decoder circuit for selecting gray level potentials to be sent to said signal lines according to said data synchronized by said gray level-synchronizing circuit.

A still other embodiment of the invention resides in a driver circuit for use with an active matrix liquid crystal display, said active matrix liquid crystal display having signal lines and scanning lines, said driver circuit receiving data about gray levels, said data being represented in terms of digital values. This driver circuit comprises: an address decoder circuit for selecting signal lines to which said data is sent; a gray level-holding circuit for holding said data about gray levels; a gray level-synchronizing circuit for synchronizing timing at which said held data is sent with timing of scanning of said liquid crystal display; and a decoder circuit for selecting one from a plurality of gray-level potential signals having different voltage values for different gray levels according to the data synchronized by said gray level-synchronizing circuit.

In one feature of the invention, a random access method using an address decoder circuit is adopted instead of the conventional line-sequential scanning method utilizing shift register circuits. The use of the address decoder circuit makes it possible to select addressed signal lines or scanning lines, in the past, lines have been sequentially specified. In the case of the line-sequential scanning using shift register circuits, one input signal is transmitted with a delay and, therefore, if one circuit becomes defective, the production yield of the finished display device is affected severely.

On the other hand, in the address decoder circuit used in the present invention, if the driver circuit connected with any one signal line or scanning line becomes faulty, driver circuits connected with other signal lines or scanning lines are not affected. Consequently, numerous display devices providing a better display than the prior art construction driven by the line-sequential scanning using shift register circuits can be obtained. As a result, display devices can be manufactured with greatly improved yield.

Furthermore, desired pixels can be randomly accessed. Therefore, the scanning time can be shortened compared with the prior art shift register which scans the successive lines sequentially during each scan. Hence, higher-speed operation can be attained.

In addition, it is necessary to operate only the circuits which activate the selected signal lines or scanning lines. Therefore, the electric power consumed can be reduced compared with the case in which shift register circuits that are required to operate up to the preceding stage are used.

Other objects and features of the invention will appear in the course of the description thereof, which follows.

DETAILED DESCRIPTION OF THE PREFERRED EMBODIMENTS

Figure 1:
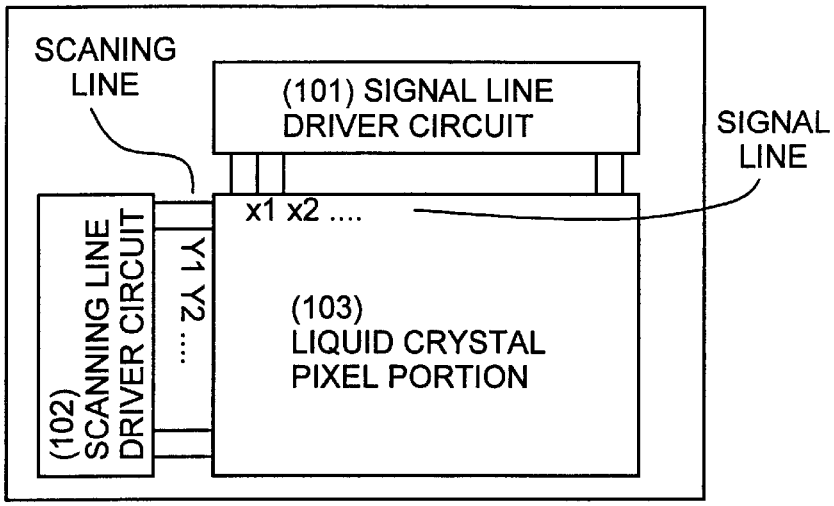
FIG.1 PRIOR ART
FIG. 1 is a schematic diagram of the prior art liquid crystal display.
Figure 2:
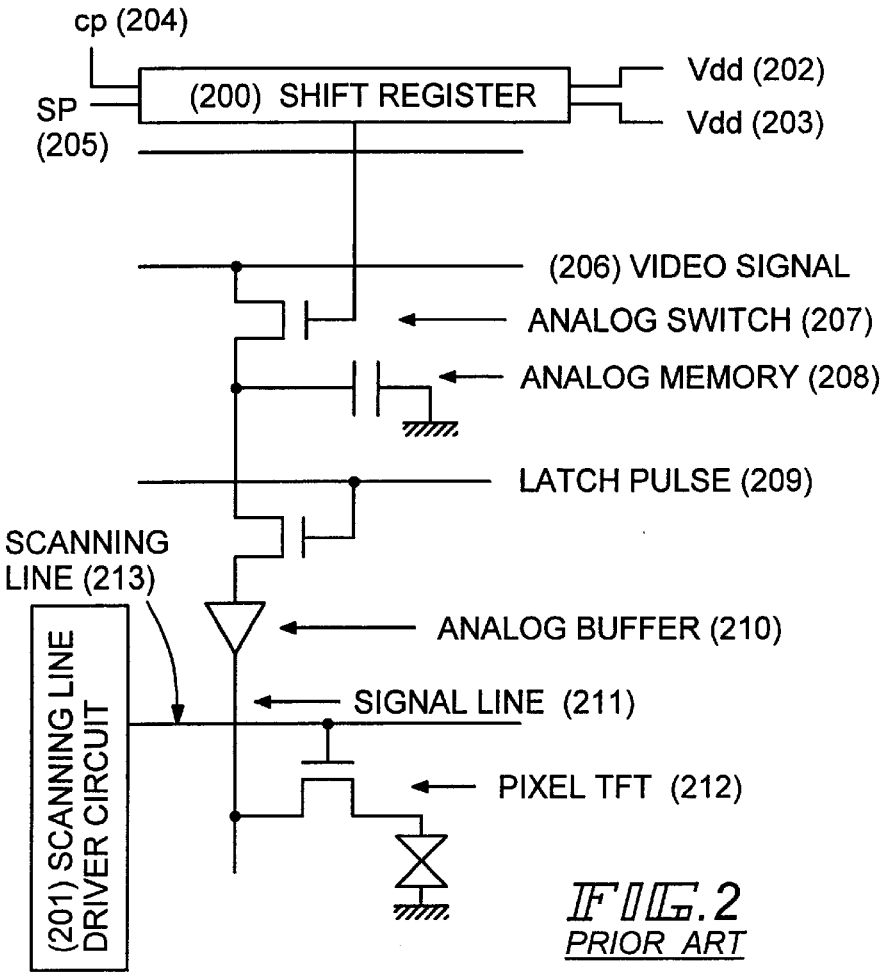
FIG.2 PRIOR ART
FIG. 2 is a diagram of an analog line-sequential scanning driver circuit using shift registers.
Figure 3:
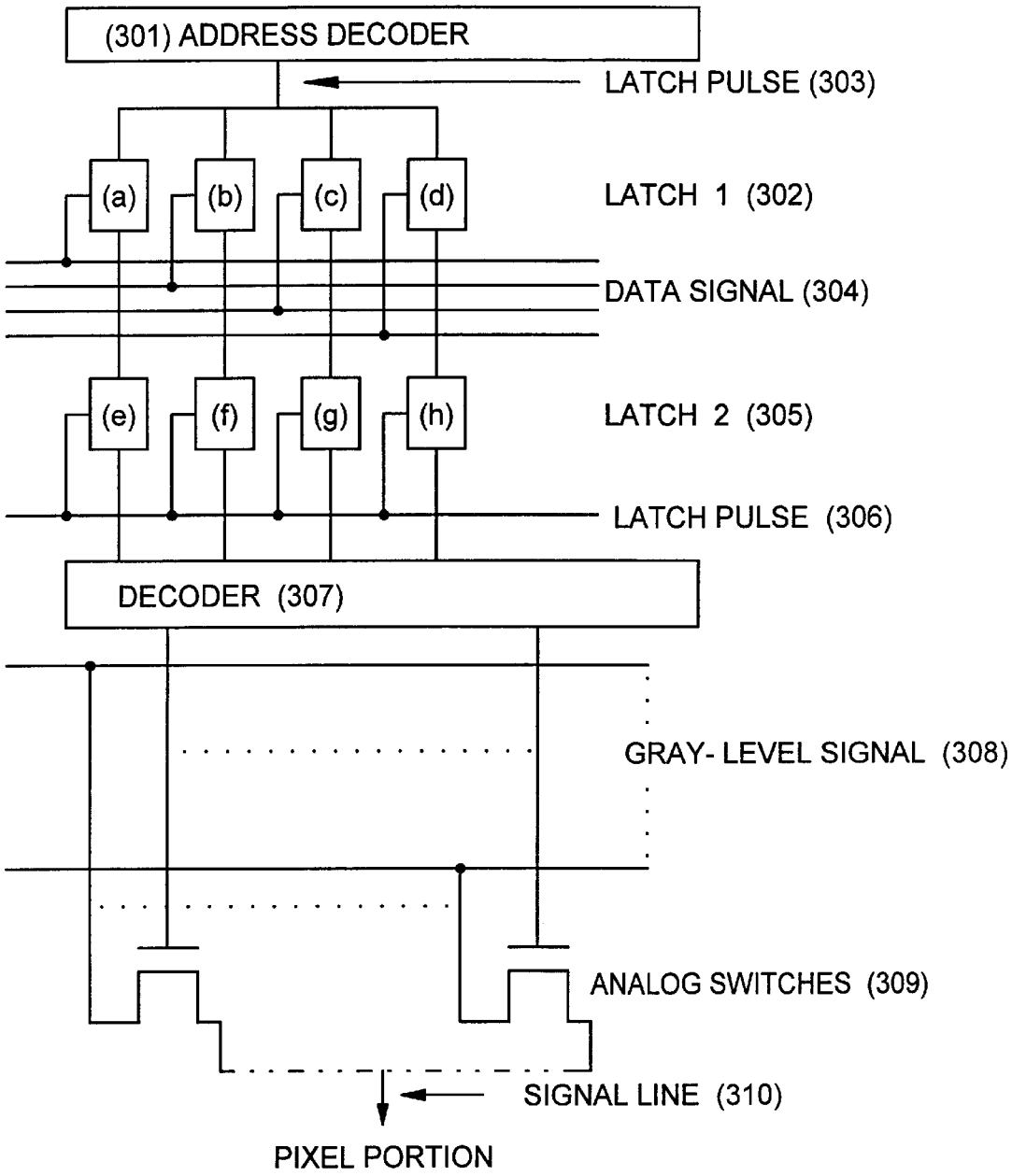
FIG. 3 is a diagram of a driver circuit using a decoder according to the present invention.

The preferred embodiments of the present invention are hereinafter described. FIG. 3 is a block diagram of a part of a signal line driver circuit which is associated with one signal line. This driver circuit uses an address decoder and has 500 signal lines in this example.

Address signals for pixels to be displayed are applied to the address decoder, 301, via external terminals (not shown). Signal lines are selected according to the values of the address signals. These address signals act as latch pulses for latches 1 (302) which are connected in parallel. The number of the latches 1 is equal to the number of bits of data signal 304 which carries data about gray levels. Each latch 1 (302) consists of a D flip-flop circuit.

The data signal 304 which carries data about gray levels is applied to these latches 1 (302). The latches 1 (302) accept gray-level signals carried by the data signal 304 at the timing of the latch pulses 303 delivered from the address decoder 301. The results are stored as logic values in the latches 1.

The selected signals are accepted as input signals to the next stage of latches 2 (305) which are connected in series with the latches 1 (302). The latches 2 (305) deliver image gray-level data to be displayed to a decoder 307 in synchronism with the first scan of the display device in response to latch pulses 306 accepted from the outside.

The output from the decoder 307 is fed to the gates of analog switches 309 which correspond to the applied gray-level data. Gray-level signals 308 are supplied to the analog switches 309. These gray-level signals 308 are created by dividing the potential corresponding to each gray level by resistors. The gray-level potentials selected in this way are sent to pixels to be activated, through signal lines 310.

In the present example, the scanning line driver circuit uses the address decoder 301 to select scanning lines.

The scanning lines need no gray-level data. Therefore, the scanning line driver circuit is so designed that only a signal line is connected with each output of the address decoder 301.

Gate electrodes of TFTs for one line are connected with each scanning line. The operation of the circuits is described below.

Figure 4:
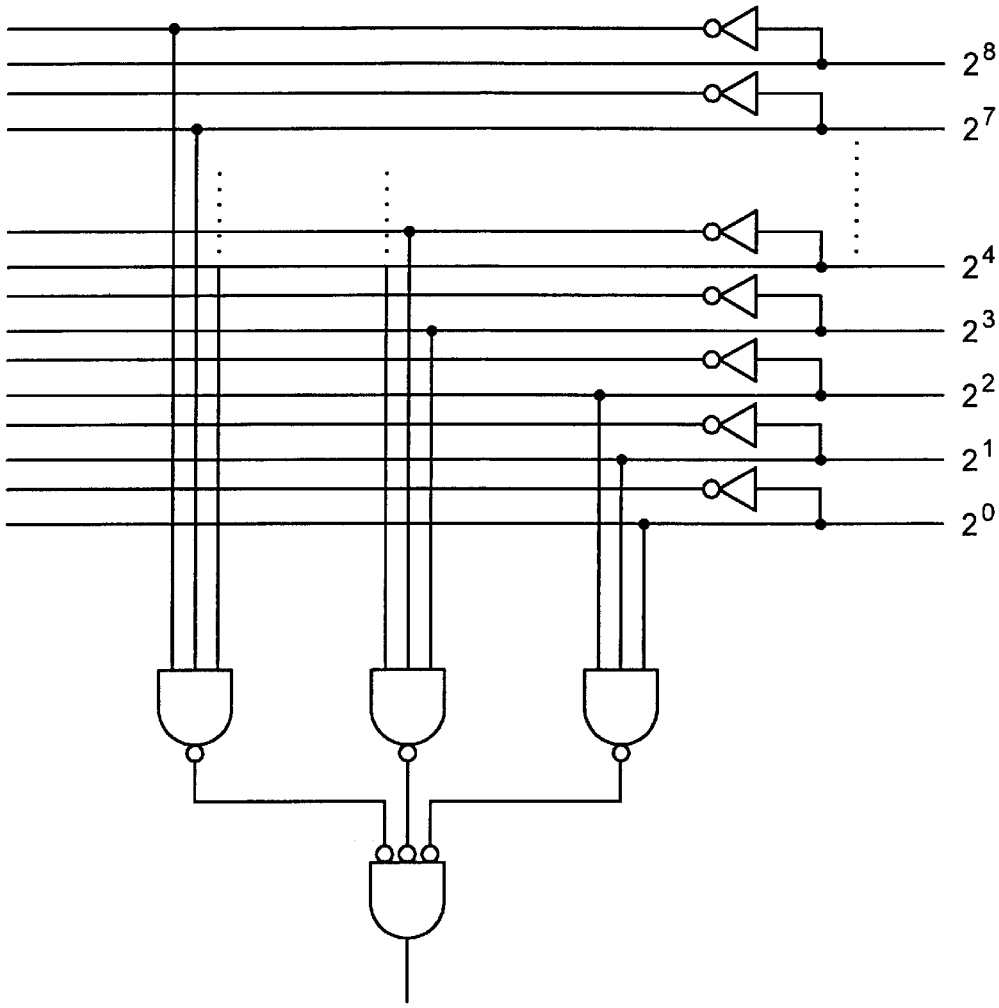
FIG. 4 is a logic circuit diagram of the decoder shown in FIG. 3.

The logic circuit of the address decoder 301 is shown in FIG. 4. In the present example, since there exist 500 signal lines, the signal line driver circuit needs a 9-bit address decoder. In total, 18 address signal lines including NOT signals are necessary.

The address decoder 301 comprises these address signal lines, 3 NAND gates, and one NOR gate, and has 9 inputs and 1 output. In the address decoder 301 constructed in this way, the inputs of the NAND gates are connected with the address signal lines corresponding to addresses for 500 signal lines. The outputs of the NOR gate is connected with the signal lines corresponding to the addresses.

If the outputs of the connected address signal lines all go high (H), the NAND gates produce a low-level (L) signal. If any one output from the address signal lines is at a low level (L), the NAND gates go high (H). If the outputs from the connected address signal lines all go high (H), and if the outputs from the three NAND gates all go low (L), then the NOR gate delivers a high-level signal (H).

That is, if the coupled address signals go high (H), the output from the address decoder 301 rises. That is, the address signals about pixels to be activated are ANDed.

The decoder portion 307 gains access to 16 gray-level signals 308 in response to 4-bit input on the same principle as the foregoing.

Figure 5:
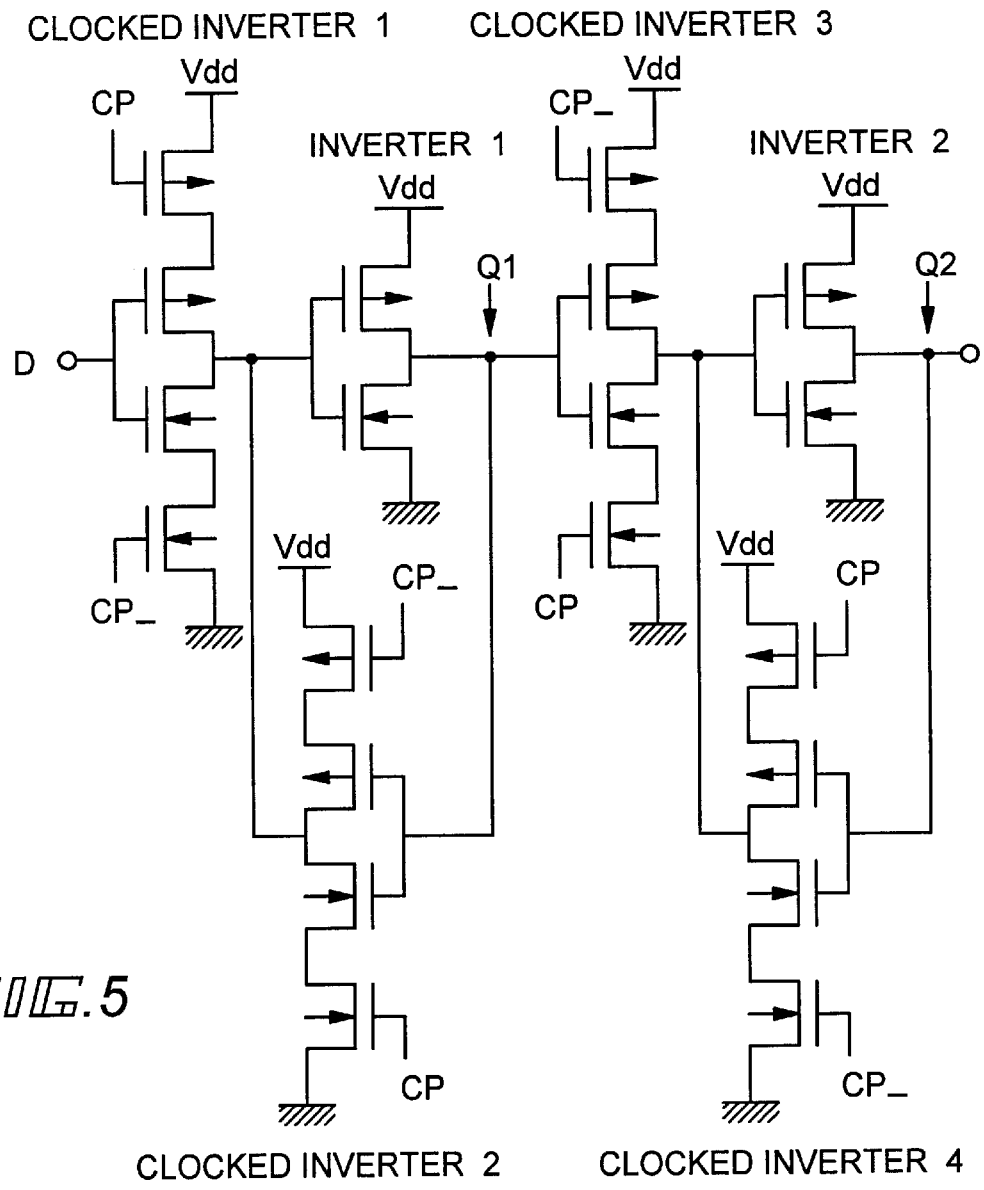
FIG. 5 is an equivalent circuit diagram of latches.

The operation of the latch circuits is described now. FIG. 5 is an equivalent circuit of a latch. In this example, a D flip-flop comprising clocked inverters 1–4 and inverters 1, 2 is used as a latch 1 (302) or a latch 2 (305).

In FIG. 5, a reset state is indicated by L. If the level of the clock pulses CP is low (L), and if the level of the input signal is high (H), the output from the clocked inverter 1 is at a low level (L). This level is inverted to a high level (H) by the inverter 1. At this time, the clocked inverter 2 is not conducting and so the output Q1 is at a high level (H).

At this time, a high-level signal (H) is applied to the clocked inverter 3. Since the clock pulses CP are at a high level (H), the clocked inverter 3 is not conducting. Therefore, a low-level signal (L) indicating the reset state appears at output Q2.

If the clock pulses CP are at a high level (H), and if the input signal is at a high level (H), the clocked inverter 1 is not conducting. On the other hand, the clocked inverter 2 is conducting and produces a low-level signal (L). This output signal is inverted to a high level (H) by the inverter 1. That is, the output Q1 goes high (H).

At this time, a high-level signal (H) is applied to the clocked inverter 3. Since the clock pulses CP are at a low level (L), the clocked inverter 3 conducts and produces a low-level signal (L). This output signal is inverted to a high level (H) by the inverter 2. Since the clocked inverter 4 is not conducting, the output Q2 is at a high level (H).

If the level of the clock pulses CP is at a low level (L) and the input signal is at a low level (L), the clocked inverter 1 conducts and produces a high-level signal (H). This signal is inverted by the inverter 1. At this time, the clocked inverter 2 is not conducting and so the output Q1 is at a low level (L).

At this time, a low-level signal (L) is applied to the clocked inverter 3. Since the clock pulses CP are at a high level (H), the clocked inverter 3 is not conducting.

A clocked inverter 4 is driven into conduction and produces a low-level signal (L). This signal is inverted to a high level (H) by the inverter 2. That is, the output Q2 is at a high level (H).

If the clock pulses CP are at a high level (H) and the input signal is at a low level (L), then the clocked inverter 1 does not conduct. The clocked inverter 2 conducts and produces a high-level signal (H). This signal is inverted to a low level (L) by the inverter 1. That is, the output Q1 is at a low level (L).

At this time, a low-level signal (L) is applied to the clocked inverter 3. Since the clock pulses CP are at a low level (L), the clocked inverter 3 conducts, thus producing a high-level signal (H). This signal is inverted to a low level (L) by the inverter 2. Since the clocked inverter 4 is not conducting, the output Q2 goes low (L).

Figure 6:
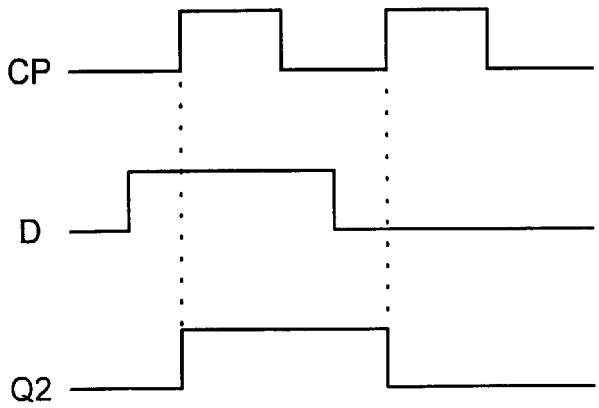
FIG. 6 is a waveform diagram showing the output waveform from a D flip-flop, as well as the waveform of clock pulses CP and the waveform of a signal appearing at the output Q2 of the circuit shown in FIG. 5.

The waveforms of the outputs from the D flip-flops described thus far are shown in FIG. 6. In this way, the level of the delayed signal (D) on the leading edge of each clock pulse CP is read, and the signal is held until the next clock pulse CP arrives.

Figure 7:
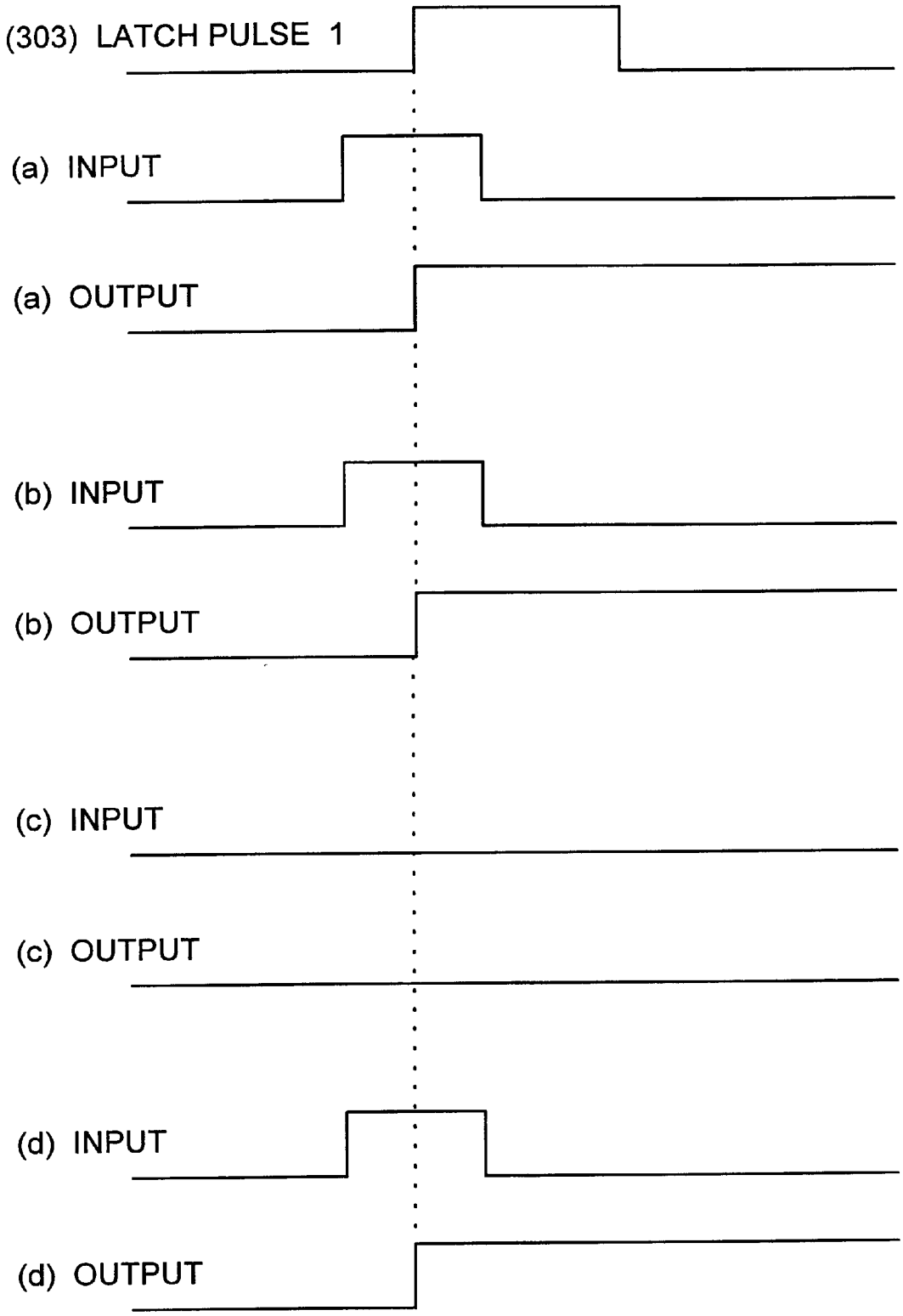
FIG. 7 is a waveform diagram showing the output waveforms from latches 1 included in the circuit shown in FIG. 3.

By following the operation of the latches 1 shown in FIG. 3, the output waveforms shown in FIG. 7 are obtained. Instead of the clock pulses CP, the output from the address decoder is applied to the latches 1. Instead of the delayed signal (D), data signal is applied to the latches 1. However, the circuit operation remains the same. It can be seen from FIG. 7 that the states of input signals (a), (b), (c), and (d) assumed when the latch pulse goes high (H) are held and produced as output signals.

Figure 8:
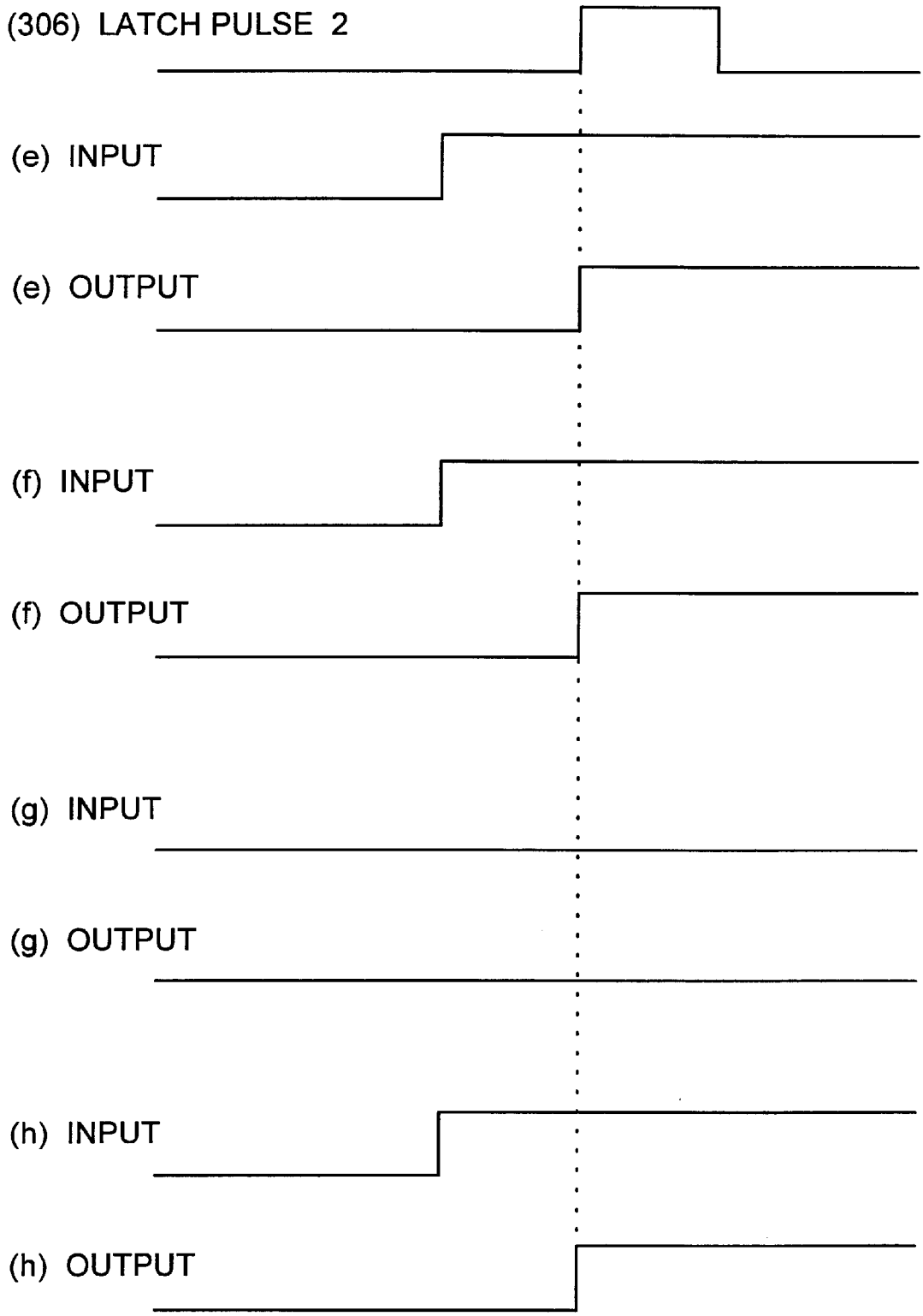
FIG. 8 is a waveform diagram showing the output waveforms from latches 2 included in the circuit shown in FIG. 3.

By following the operation of the latches 2, the waveforms shown in FIG. 8 is obtained. In this case, latch pulses are applied instead of the clock pulses CP. Instead of the delayed signal (D), the output from the latches 1 is applied.

It can be seen from FIG. 8 that the states of input signals (e), (f), (g), and (h) assumed when the latch pulse goes high (H) are held and produced as output signals. That is, the scanning timing is controlled by the accepted latch pulses.

We fabricated a liquid crystal display, using the signal line driver circuit and the scanning line driver circuit constructed as described above. This liquid crystal display comprises a single glass substrate on which a liquid crystal display portion, the signal line driver circuit, and the scanning line driver circuits for forming an active matrix construction are formed. Thus, a monolithic integrated circuit is formed. As a result, the liquid crystal display fabricated in the present example can provide a better display than an apparatus which makes use of shift registers and in which all circuits located after a defective circuit are made useless if such a defective circuit is present. The present example greatly improves the production yield and reduces the cost.

Furthermore, it is not necessary to supply any signal to circuits connected with unselected signal lines or scanning lines, unlike the case in which shift registers are used. Consequently, the electric power consumed can be reduced. Moreover, random access is possible. Therefore, only pixels about contents of display to be modified can be rewritten. Hence, lower electric power consumption and higher-speed operation can be accomplished.

Additionally, the used liquid crystal material is not limited to nematic liquid crystals. Use of a ferroelectric liquid crystal material capable of acting as a memory is useful, because random access is possible.

In the present example, both signal line driver circuit and scanning line driver circuit are built, using address decoder circuits. Any one of them may be the prior art shift register circuit.

As described above, the novel driver circuit for a display device is constructed, using an address decoder instead of shift registers. Therefore, random access to pixels to be displayed is possible. Accordingly, numerous display devices capable of providing a better display than the display devices using shift registers can be obtained. As a result, display devices can be manufactured with much higher yield than heretofore. Furthermore, lower electric power consumption and higher-speed operation can be achieved. In addition, the cost of the display device can be reduced.

What is claimed is:

1. A method of driving a display device comprising the steps of:

selecting a signal line to which a gray-level data is output by an address decoder circuit, said address decoder circuit comprising at least three NAND gates and one NOR gate;

holding said gray-level data in a gray-level holding circuit;

synchronizing a timing of when said gray-level data held in said gray-level holding circuit is sent with a scanning timing of said display device; and selecting a gray-level potential to be sent to said signal line by a decoder circuit according to said synchronized gray-level data.

2. A method according to claim 1, wherein said display device is a liquid crystal display device.

3. A method according to claim 1 wherein a random access method is adopted in said method.

4. A method according to claim 1 wherein said display device further comprises scanning line driver circuit comprising an address decoder circuit.

5. A method according to claim 1 wherein said display device further comprises a scanning line driver circuit comprising a shift register circuit.

6. A method according to claim 1 wherein an analog switch is connected to said decoder circuit.

7. A method of driving a display device comprising the steps of:

selecting a signal line to which a gray-level data is output by an address decoder circuit, said address decoder circuit comprising at least three NAND gates and one NOR gate;

storing said gray-level data from said address decoder circuit in a first latch in response to a latch pulse;

receiving said gray-level data from said first latch in a second latch; and selecting a gray-level potential to be sent to said signal line by a decoder circuit in accordance with said gray-level data received from said second latch.

8. A method according to claim 7 wherein said display device is a liquid crystal display device.

9. A method according to claim 7 wherein a random access method is adopted in said method.

10. A method according to claim 7 wherein said display device further comprises a scanning line driver circuit comprising an address decoder circuit.

11. A method according to claim 7 wherein said display device further comprises a scanning line driver circuit comprising a shift register circuit.

12. A method according to claim 7 wherein an analog switch is connected to said decoder circuit.

13. A method according to claim 7 wherein said first latch comprises a D flip-flop circuit.

14. A method of driving a display device using a ferroelectric liquid crystal, comprising the steps of:

selecting a signal line to which a gray-level data is output by an address decoder circuit, said address decoder circuit comprising at least three NAND gates and one NOR gate;

holding said gray-level data in a gray-level holding circuit;

synchronizing a timing of when said gray-level data held in said gray-level holding circuit is sent with a scanning timing of said display device; and selecting a gray-level potential to be sent to said signal line by a decoder circuit according to said synchronized gray-level data.

15. A method according to claim 14 wherein a random access method is adopted in said method.

16. A method according to claim 14 wherein said display device further comprises a scanning line driver circuit comprising an address decoder circuit.

17. A method according to claim 14 wherein said display device further comprises a scanning line driver circuit comprising a shift register circuit.

18. A method according to claim 14 wherein an analog switch is connected to said decoder circuit.

19. A method of driving a display device using a ferroelectric liquid crystal, comprising the steps of:

selecting a signal line to which a gray-level data is output by an address decoder circuit, said address decoder circuit comprising at least three NAND gates and one NOR gate;

storing said gray-level data from said address decoder circuit in a first latch in response to a latch pulse;

receiving said gray-level data from said first latch in a second latch; and selecting a gray-level potential to be sent to said signal line by a decoder circuit according to said synchronized gray-level data.

20. A method according to claim 19 wherein a random access method is adopted in said method.

21. A method according to claim 19 wherein said display device further comprises a scanning line driver circuit comprising an address decoder circuit.

22. A method according to claim 19 wherein said display device further comprises a scanning line driver circuit comprising a shift register circuit.

23. A method according to claim 19 wherein an analog switch is connected to said decoder circuit.

24. A method according to claim 19 wherein said first latch comprises a D flip-flop circuit.

* * * * *